United States Patent [19]

Watanabe et al.

[11] Patent Number: 4,914,344

[45] Date of Patent: Apr. 3, 1990

[54] SPARK PLUG FOR INTERNAL COMBUSTION ENGINES

[75] Inventors: Kiyohiko Watanabe, Chiryu; Toshihiko Igashira, Toyokawa; Takeo Miyoshi, Toyota; Masahiro Yamashita, Toyota; Hiroshi Hosoi, Toyota; Noboru Takagi, Toyota, all of Japan

[73] Assignees: Nippon Soken, Inc., Nishio; Toyota Jidosha Kabushiki Kaisha, Toyota, both of Japan

[21] Appl. No.: 227,852

[22] Filed: Aug. 3, 1988

[30] Foreign Application Priority Data

Aug. 4, 1987 [JP] Japan ..... 62-195058

[51] Int. Cl.[4] ..... H01T 13/20; H01T 13/46

[52] U.S. Cl. ..... 313/141; 313/140

[58] Field of Search ..... 313/131 A, 140, 141, 313/142

[56] References Cited

U.S. PATENT DOCUMENTS

| | | | |
|---|---|---|---|
| 2,734,143 | 2/1956 | Laird | 313/131 A |
| 3,313,972 | 4/1967 | Beesch | 313/130 |
| 3,353,052 | 11/1967 | Barry | 313/141 X |
| 3,970,591 | 7/1976 | Harris | 252/521 |

FOREIGN PATENT DOCUMENTS

| | | |
|---|---|---|
| 0118789 | 2/1984 | Fed. Rep. of Germany . |
| 3338672 | 3/1985 | Fed. Rep. of Germany . |
| 3407011 | 9/1985 | Fed. Rep. of Germany . |
| 1043443 | 11/1953 | France . |
| 1446036 | 6/1966 | France . |
| 57-40886 | 3/1982 | Japan . |
| 58-204484 | 11/1983 | Japan . |
| 59-173986 | 10/1984 | Japan . |
| 60-81784 | 5/1985 | Japan . |
| 61-42890 | 3/1986 | Japan . |
| 62-5582 | 1/1987 | Japan . |
| 2063363 | 6/1981 | United Kingdom . |

*Primary Examiner*—Kenneth Wieder

*Attorney, Agent, or Firm*—Cushman, Darby & Cushman

[57] ABSTRACT

A spark plug for internal combustion engines includes a third electrode in addition to a center electrode and a ground electrode which define a normal or main spark gap. Defined between the center electrode and the third electrode is an auxiliary gap adjoining the normal gap and adapted to produce a capacitive discharge at a voltage lower than that of the normal gap, and a discharge is induced across the normal gap by the capacitive discharge across the auxiliary gap.

7 Claims, 5 Drawing Sheets

SPARK PLUG FOR INTERNAL COMBUSTION ENGINES

BACKGROUND OF THE INVENTION

The present invention relates to a spark plug for internal combustion engines.

Spark plugs heretofore known in the art have been generally of the type including a center electrode and a ground electrode which define a spark gap therebetween. Then, in recent years there has existed, for the purpose of improving the performance of an internal combustion engine (hereinafter referred to as an engine), a demand for improving the ignition performance through the realization of a higher compression ratio, the use of a lean-burn system, the installation of a turbocharger, etc., and attempts have been made to use wider spark gaps. Therefore, the plug voltage required has been going on increasing.

Measures heretofore proposed for the purpose of reducing the plug voltage required include for example means of decreasing the electrodes in diameter and this causes an increased in the electrode consumption and deterioration in the electrode durability. Thus, while means of forming the electrode tips with less-consumable platinum may be conceived, this means is also disadvantageous from the cost point of view.

SUMMARY OF THE INVENTION

The present invention has been made in view of the foregoing circumstances and it is an object of the invention to provide a spark plug which has a wider gap, yet requires the lower voltage than previously.

To accomplish the above object, in accordance with the invention there is thus provided a spark plug including a center electrode and a ground electrode which define a normal or main spark gap therebetween as well as a third electrode arranged to define an auxiliary gap between it and the center electrode and grounded through a capacitance component.

When a high voltage is applied to the center electrode, a capacitive discharge (first capacitive discharge) is first produced at the auxiliary gap between the center electrode and the third electrode to extend along the forward end face of the plug insulator. In this case, the capacitance component (capacitor) is formed between the conductor forming the third electrode and the housing so that the discharge is continued until the charge is fully stored in the capacitor. Then, a capacitive discharge (second capacitive discharge) is produced by the first capacitive discharge at the spark gap between the center electrode and the ground electrode and this capacitive discharge passes into an inductive discharge.

In accordance with the invention, by virtue of the fact that a spark plug includes a third electrode in addition to a center electrode and a ground electrode so that an auxiliary gap arranged near to a normal gap and requiring the lower voltage than that of the normal gap for producing a capacitive discharge is defined between the center electrode and the third electrode and a capacitive discharge at the auxiliary gap induces a discharge at the normal gap, the plug voltage required can be made lower than previously and the normal gap can be widened thereby improving the ignition performance.

In accordance with the invention, the first capacitive discharge is a creepage-surface discharge which is initiated by a relatively low voltage and its ionization action in the vicinity of the center electrode reduces the discharge voltage for the second capacitive discharge to a low value.

DESCRIPTION OF THE PREFERRED EMBODIMENTS

Figure 1:
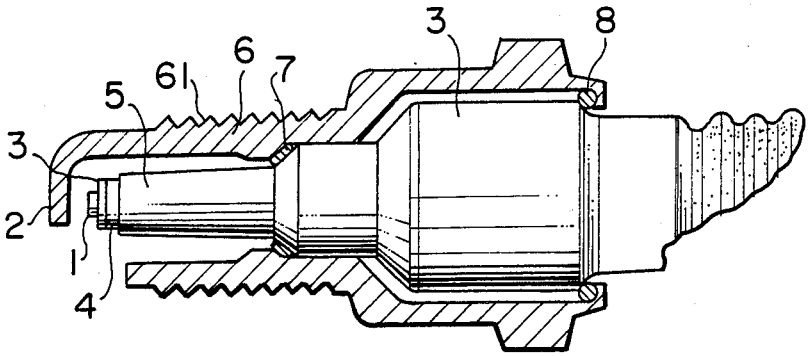
FIG. 1 is a sectional view showing a first embodiment of the invention.
Figure 2:
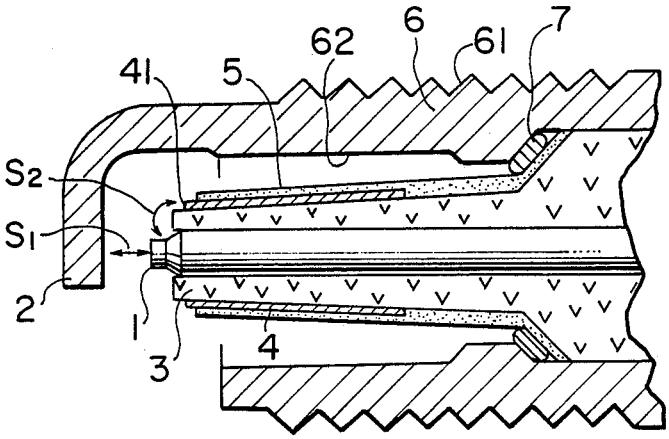
FIG. 2 is an enlarged sectional view showing the principal part of FIG. 1.

Referring to FIGS. 1 and 2 showing a first embodiment of the invention, a main spark gap $S_1$ is defined between the forward end of a center electrode 1 and a ground electrode 2. The center electrode 1 is extended through the axial hole of an insulator 3 made of an alumina porcelain so that its forward end projects from the forward end face of the insulator 3. A coating of conductive material (e.g., platinum) is applied on the forward-end outer periphery of the insulator 3 around the center electrode 1 thereby forming a third electrode 4. The third electrode 4 is covered with a dielectric (such as, alumina or SiC) so as to expose only its forward end 41 and thus it does not contact with a housing 6.

An auxiliary gap $S_2$ is defined between the third electrode 4 and the center electrode 1. With the auxiliary gap $S_2$, the creepage distance of about 3 mm or less is effective and it should preferably be selected about 0.5 to 3 mm. A capacitance component (capacitor) is provided by a housing inner surface 62 and the third electrode 4 and the magnitude C of its capacitance is determined by the length of the coating. In the case of this embodiment, alumina is used as the dielectric 5 and the capacitance of the capacitance component is about C $=12$ pF.

The plug central part, constructed as described above, is received in the housing 6 and it is fastened to the housing 6 through a packing 7 and a ring 8. The L-shaped ground electrode 2 is welded to the forward end of the housing 6 and the main gap $S_1$ is defined between the forward end of the center electrode 1 and the forward end of the ground electrode 2 as mentioned previously. The housing 6 is fitted into the cylinder head of the engine by means of threads 61 formed on its outer surface.

Figure 3:
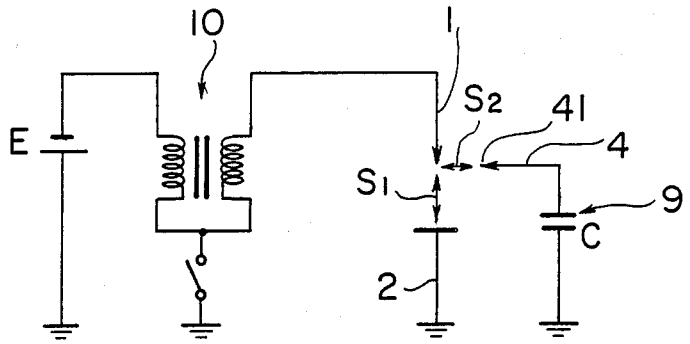
FIG. 3 is an equivalent circuit diagram of the first embodiment.

Referring to FIG. 3, there is illustrated an equivalent circuit of the present spark plug. In the Figure, symbol E designates a power supply, 10 an igniter coil, 1 the center electrode, 2 the ground electrode, 4 the third electrode, 9 the capacitor, $S_1$ the main spark gap, and $S_2$ the auxiliary gap.

With the spark plug of the invention constructed as described above, when a high voltage is applied to the center electrode 1, a weak and first capacitive discharge is first produced at the auxiliary gap $S_2$. This is due to the fact that contrary to the main gap $S_1$ at which the discharge is initiated by an atmospheric or air-space discharge, the discharge at the auxiliary gap $S_2$ is started with a creepage surface discharge and thus the voltage required for discharge at the auxiliary gap $S_2$ is low. Then, since the third electrode 4 is grounded through the capacitance component (capacitor), the discharge occurs only to the third electrode 4 in an amount corresponding to the capacitor capacitance and it does not pass into an inductive discharge.

When the discharge is produced at the auxiliary gap $S_2$, many ions and free electrons are produced. Then, these ions and free electrons serve as a trigger to produce a second capacitive discharge at the main gap $S_1$ and it passes into an inductive discharge.

Figure 4:
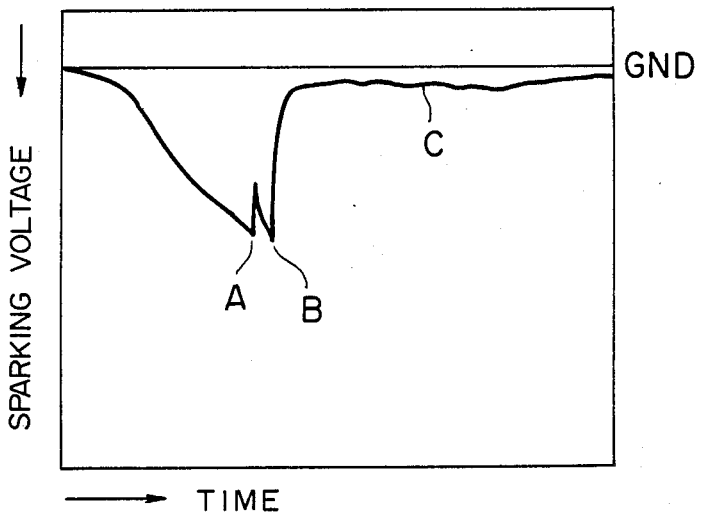
FIG. 4 is a discharge voltage waveform diagram.

FIG. 4 shows discharge voltage waveforms of the spark plug according to the first embodiment, with symbol A showing a first capacitive discharge produced at the auxiliary gap $S_2$, B a second capacitive discharge produced at the main gap $S_1$, and C an inductive discharge produced at the main gap $S_1$.

According to experiments conducted by the inventors, etc., it has been confirmed that the voltage required for the second capacitive discharge can be reduced by about 20% or over as compared with the case where the third electrode 4 is not used, that is, the first capacitive discharge is not produced.

Figure 9:
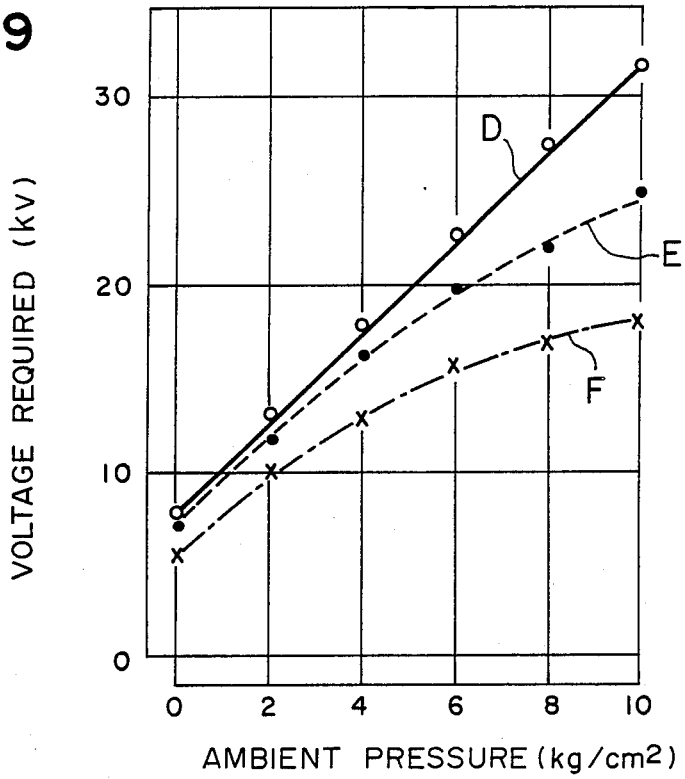
FIG. 9 is a characteristic diagram showing comparisons among the voltage requirements of the first and second embodiments of the invention and the conventional spark plug.

FIG. 9 shows the results obtained by measuring the voltage requirements (D: solid line) of the conventional spark plug without the third electrode 4 and the voltage requirements (E: broken line) of the spark plug according to the invention while varying the ambient pressure from 0 to 10 Kg/cm$^2$. Each of the spark plugs used had a main gap of 1.4 mm and the spark plug of the invention had an auxiliary gap of 1 mm. The voltage requirements of the spark plug according to the invention were lower than those of the conventional spark plug by about 20%. Therefore, as compared with the conventional spark plug, the spark plug of this invention can widen the main gap without increasing the voltage required, thereby correspondingly improving the ignition performance. The suitable auxiliary gap width is about 0.5 to 3 mm. It is to be noted that the energy of the discharge at the auxiliary gap $S_2$ is so small that there is no danger of causing a flame at the auxiliary gap $S_2$ and the electrode consumption at the forward end 41 of the third electrode 4 is very small.

Also, when a discharge is produced at the main gap $S_1$, the charge stored in the capacitor provided by the third electrode 4 flows therewith to the ground electrode 2. As a result, substantially the same discharge energy as the conventional spark plug is supplied to the main gap $S_1$ and there is caused no detrimental effect on the ignition performance.

Figure 5:
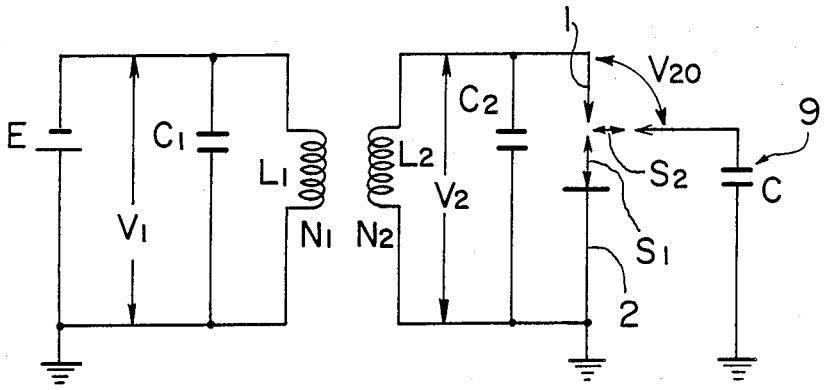
FIG. 5 is an equivalent circuit diagram for explaining the effective range of the capacitor capacitance C.

Also, as regards the value of the capacitance component C to be provided, referring to the equivalent circuit of FIG. 5 the following represent holds.

$L_1$, $L_2$=primary and secondary coil inductances
$C_1$, $C_2$=primary and secondary capacitances
$V_1$, $V_2$=primary and secondary voltages
I =primary current
$N_1$, $N_2$=numbers of turns of primary and secondary coils When there is no discharge at the normal gap $S_1$, the following energy equations hold $$1/2L_1I^2 = 1/2C_1V_1^2 + 1/2(C_2 + C)V_{20}^2$$

$$V_1 = (N_1/N_2) \cdot V_{20}$$

$$V_{20} = I\sqrt{L_1/\{C_1(N_1/N_2)^2 + (C_2 + C)\}}$$

In order to produce a discharge at the main gap $S_1$, at least the following relation must hold $$V_2 < V_{20}$$

Therefore, the capacitance C of the capacitor 9 must satisfy at least the following relation $$C < \frac{I^2}{V_2^2} L_1 - C_1(N_1/N_2)^2 - C_2$$

Also, since experiments have shown that remarkable effects can be obtained when C =3pF or over, it is necessary to satisfy the following relation $$3pF < C < \frac{I^2}{V_2^2} \cdot L_1 - C_1\left(\frac{N_1}{N_2}\right)^2 - C_2$$

In addition, where alumina is used as the dielectric 5 as in the case of the present embodiment, structurally the capacitance component C of 3 pF to 25 pF is effective.

Further, while, in the first embodiment, the dielectric 5 is grounded to the housing 6, this is not always necessary.

Further, where a material of a high dielectric constant or a semiconductor is used as the dielectric 5, the dielectric 5 can serve concurrently as the third electrode 4 and therefore the coating of the conductive material on the insulator outer surface can be eliminated.

Figure 6:
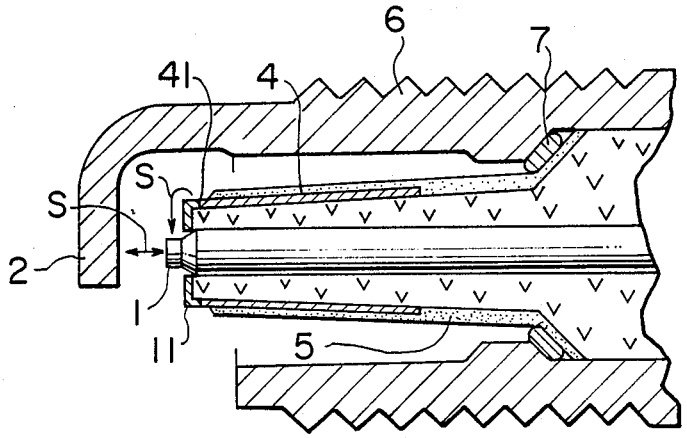
FIG. 6 is a partial sectional view showing a second embodiment of the invention.

Referring to FIG. 6, there is illustrated a second embodiment of the invention.

The second embodiment differs from the first embodiment in that a coating of semiconductor material 11 (e.g., SiC, resistance value $\simeq 2\Omega$) is applied on the insulator 3 between the center electrode 1 and the forward end 41 of the third electrode 4.

The resistance value Rg of the semiconductor coating 11 has the effect of reducing the voltage required, if it is about 0.3 MΩ to 1000 MΩ.

Figure 7:
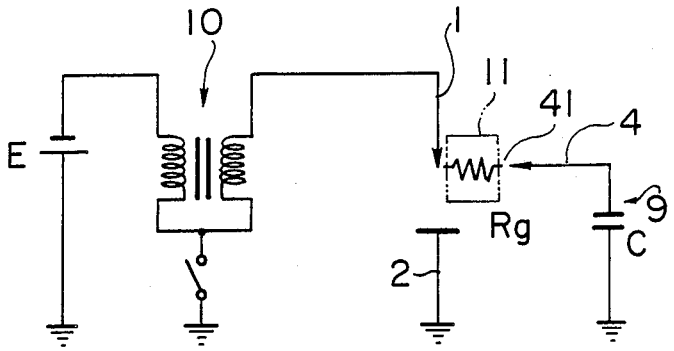
FIG. 7 is an equivalent circuit diagram of the second embodiment.

FIG. 7 shows an equivalent circuit of the spark plug according to the second embodiment. The semiconductor coating 11 having the resistance value Rg is provided in the auxiliary gap $S_2$ between the center electrode 1 and the third electrode 4.

While the spark plug of this embodiment has the same functions and effects as the first embodiment, when a first capacitive discharge is produced at the auxiliary gap $S_2$, more ions and free electrons are produced around the center electrode 1 by the action of the semiconductor coating 11 than in the case of the first embodiment. As a result, the voltage required for a second capacitive discharge produced at the main gap $S_1$ is lower than in the case of the first embodiment. FIG. 9 shows the exemplary measurements (the dot-and-dash line F) of the voltage required in the case of the present embodiment. The spark plug of this embodiment shows a large rate of decrease in the voltage required as compared with the conventional spark plug as well as the first embodiment.

Also, in the case of this embodiment, the same effect can be obtained by injecting metal ions into the insulator 3 and modifying the insulator surface in place of the coating of the semiconductor material 11 for the purpose of providing the resistor Rg.

Figure 8:
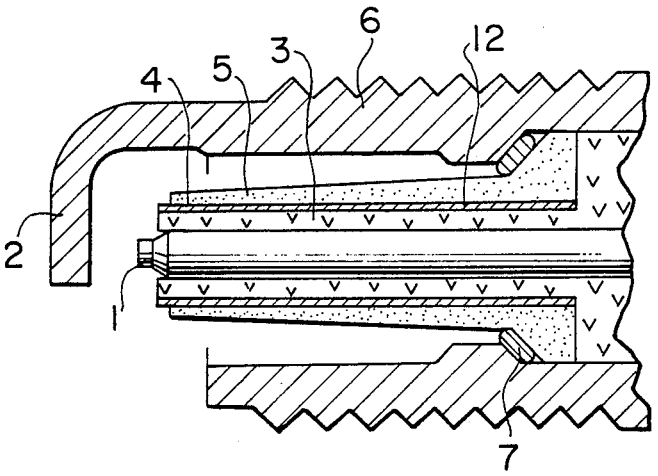
FIG. 8 is an enlarged sectional view showing a third embodiment of the invention.

FIG. 8 shows a third embodiment of the invention which differs from the first embodiment in that the coating of the third electrode 4 is applied to the outer peripheral surface of the insulator 3 and the dielectric 5 comprises a cylindrical sintered ceramic which is fitted on the outer periphery of the insulator 3 and sealed and fastened thereto with an adhesive 12, and the remaining construction is substantially the same as the first embodiment. While the provision of the dielectric 5 by means of coating has a limitation to its thickness, the present embodiment can increase the thickness as compared with the first embodiment thereby increasing the insulation resistance between the third electrode 4 and the housing 6.

Figure 10:
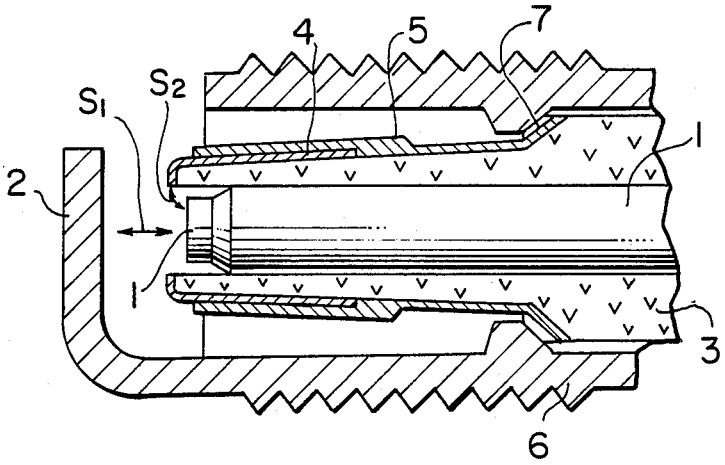
FIG. 10 is a partial enlarged sectional view showing a fourth embodiment of the invention.

FIG. 10 shows a fourth embodiment of the invention which differs from the first embodiment in that the center electrode 1 is not projected from the forward end face of the insulator 3.

This embodiment can expect a greater ionization effect by positioning the main gap $S_1$ and the auxiliary gap $S_2$ close to each other.

While, in each of these embodiments, the auxiliary gap $S_2$ is a creepage surface gap, the auxiliary gap $S_2$ may be either a space gap or a creepage-surface gap plus space gap provided that the discharge begins at a lower voltage than the normal gap $S_1$.

We claim:

1. A spark plug for internal combustion engines comprising:

a center electrode;

an insulator enclosing said center electrode;

a metal housing enclosing said insulator;

a ground electrode extending from a forward end of said housing to a forward end of said center electrode to define a spark gap between said ground electrode and the forward end of said center electrode; and a third electrode arranged to define an auxiliary, creepage-surface gap between said third electrode and said center electrode and grounded through a capacitance component so as to generate a capacitive discharge between the center electrode and the third electrode.

2. A spark plug according to claim 1, wherein said third electrode comprises an electrically conductive material diffused into a surface portion of said insulator.

3. A spark plug according to claim 2, wherein said capacitance component is formed by said electrically conductive material.

4. A spark plug according to claim 3, wherein said electrically conductive material comprises a thin metallic film.

5. A spark plug according to claim 3, wherein said electrically conductive material is covered with a dielectric material.

6. A spark plug according to claim 1, wherein said creepage-surface gap is formed on a semiconductor.

7. A spark plug according to claim 1, wherein said third electrode comprises a thin semiconductor ceramic thin film formed on a surface of said insulator.

* * * * *